US009200440B2

(12) United States Patent
Kmiecinski et al.

(10) Patent No.: US 9,200,440 B2
(45) Date of Patent: Dec. 1, 2015

(54) FLAT, PREFERABLY FLEXIBLE FIRE PROTECTION UNIT AND DEVICE FOR SHUTTING OFF A ROOM AGAINST A FLUID, ESPECIALLY AN INFLAMMABLE LIQUID FLOWING INTO THE ROOM OR OUT OF THE ROOM

(75) Inventors: René Kmiecinski, Moers (DE); Dag Anhamm, Moers (DE)

(73) Assignee: ANHAMM GMBH, Moers (DE)

( * ) Notice: Subject to any disclaimer, the term of this patent is extended or adjusted under 35 U.S.C. 154(b) by 268 days.

(21) Appl. No.: 12/993,735

(22) PCT Filed: May 20, 2009

(86) PCT No.: PCT/EP2009/056170

§ 371 (c)(1),
(2), (4) Date: Mar. 11, 2011

(87) PCT Pub. No.: WO2009/141394

PCT Pub. Date: Nov. 26, 2009

(65) Prior Publication Data

US 2011/0155399 A1 Jun. 30, 2011

(30) Foreign Application Priority Data

May 21, 2008 (DE) ..... 10 2008 024 575

(51) Int. Cl.

| | |
|---|---|
| ***A62C 8/00*** | (2006.01) |
| ***A62C 3/00*** | (2006.01) |
| ***E04B 1/94*** | (2006.01) |
| ***E04C 2/296*** | (2006.01) |
| ***A62C 8/06*** | (2006.01) |
| ***A62C 2/06*** | (2006.01) |

(52) U.S. Cl.
CPC . *E04B 1/942* (2013.01); *A62C 2/06* (2013.01); *A62C 8/06* (2013.01); *E04C 2/296* (2013.01)

(58) Field of Classification Search
CPC ..... E04B 1/942; E04C 2/296
USPC ..... 169/54, 28, 48–51, 56; 52/64, 232, 52/243.1; 420/920–921
See application file for complete search history.

(56) References Cited

U.S. PATENT DOCUMENTS

| | | | | | |
|---|---|---|---|---|---|
| 2,340,370 | A | * | 2/1944 | Doyle | 169/50 |
| 2,560,269 | A | * | 7/1951 | Berner | 169/48 |
| 3,782,475 | A | * | 1/1974 | Schmidt | 169/50 |
| 3,934,066 | A | | 1/1976 | Murch | |
| 4,232,742 | A | * | 11/1980 | Dick | 169/58 |
| 4,956,218 | A | * | 9/1990 | Haining | 428/102 |
| 5,192,598 | A | * | 3/1993 | Forte et al. | 428/71 |
| 5,481,834 | A | * | 1/1996 | Kowalczyk et al. | 52/64 |
| 5,490,567 | A | * | 2/1996 | Speer | 169/50 |
| 5,634,304 | A | * | 6/1997 | Sakno | 52/232 |

(Continued)

FOREIGN PATENT DOCUMENTS

| | | |
|---|---|---|
| CH | 544044 | 10/1971 |
| DE | 7715947 | 9/1977 |

(Continued)

*Primary Examiner* — Len Tran
*Assistant Examiner* — Alexander Valvis
(74) *Attorney, Agent, or Firm* — BainwoodHuang

(57) ABSTRACT

The invention relates to a flat, flexible fire protection unit (1). Said fire protection unit comprises at least one porous carrier structure (2), the pores (3) of said carrier structure (2) being at least partially filled with an agent (4) that undergoes a change in state of aggregation under the effect of heat.

11 Claims, 4 Drawing Sheets

(56) References Cited

U.S. PATENT DOCUMENTS

Figure 1:
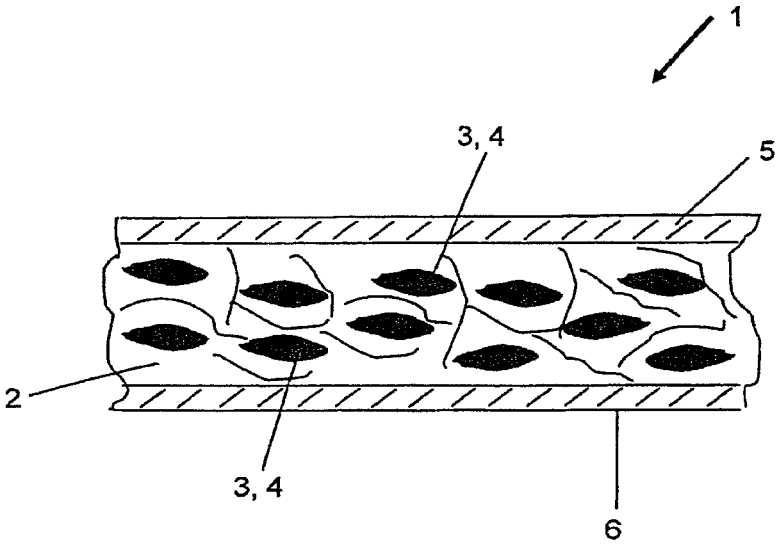

| | | | | |
|---|---|---|---|---|
| 5,735,098 | A * | 4/1998 | Kanai et al. | 52/508 |
| 5,809,699 | A | 9/1998 | Joly | |
| 5,832,676 | A * | 11/1998 | Gillmore et al. | 52/67 |
| 5,885,912 | A * | 3/1999 | Bumbarger | 442/239 |
| 6,004,890 | A * | 12/1999 | Ueda et al. | 442/136 |
| 6,136,423 | A * | 10/2000 | Fitzpatrick | 428/304.4 |
| 6,371,977 | B1 * | 4/2002 | Bumbarger et al. | 607/108 |
| 6,551,951 | B1 * | 4/2003 | Fay et al. | 442/82 |
| 6,806,215 | B2 * | 10/2004 | Grilliot et al. | 442/268 |
| 6,941,720 | B2 * | 9/2005 | DeFord et al. | 52/783.14 |
| 6,983,805 | B2 * | 1/2006 | Chattaway | 169/46 |
| 7,225,882 | B2 * | 6/2007 | Miller et al. | 169/45 |
| 7,385,480 | B2 * | 6/2008 | Fitzpatrick | 340/286.05 |
| 2002/0162295 | A1 * | 11/2002 | Keshmiri | 52/653.1 |
| 2008/0190626 | A1 * | 8/2008 | Freitag et al. | 169/16 |
| 2008/0217028 | A1 * | 9/2008 | Crumpton | 169/48 |
| 2011/0297402 | A1 * | 12/2011 | Belmonte et al. | 169/56 |

FOREIGN PATENT DOCUMENTS

| | | | |
|---|---|---|---|
| DE | 29622647 | U1 | 9/1996 |
| DE | 19611515 | A1 | 10/1996 |
| DE | 19610532 | A1 | 11/1996 |
| EP | 0123255 | A1 | 4/1984 |
| WO | 8200040 | | 1/1982 |
| WO | 94/22669 | A1 | 10/1996 |
| WO | 9919140 | | 4/1999 |
| WO | 2007057202 | A1 | 5/2007 |

* cited by examiner

FLAT, PREFERABLY FLEXIBLE FIRE PROTECTION UNIT AND DEVICE FOR SHUTTING OFF A ROOM AGAINST A FLUID, ESPECIALLY AN INFLAMMABLE LIQUID FLOWING INTO THE ROOM OR OUT OF THE ROOM

The subject of the invention relates to a sheet-like, preferably flexible fire protection unit and to a device for shutting off a room against a fluid, especially an inflammable liquid, flowing into the room or out of the room.

For the protection of built objects, for example buildings, structures or other set-ups, various fire protection measures are carried out. Thus, for example, a sheet-like, flexible fire protection unit is known from CH 544 044. The fire protection unit is produced in the form of a fire protection foil which is incombustible and heat-insulating. The fire protection unit has a foil-like carrier material with a glass fiber mat. A layer of liquid and powdery water glass is coated onto the glass fiber mat and is subsequently solidified. Solidification may take place by curing or drying. The advantage of such a fire protection foil according to the publication CH 544 044 is that, even under the effect of very high temperatures, it has a coherent closed protective layer which exhibits no crack formation even under the lengthy action of heat.

The publication DE 296 22 647 U1 discloses a high-temperature proofing system. The proofing system has a bulkhead element for providing fire protection, made from metal. To form a proofing shield arranged in front of the fireproof bulkhead in the direction of action of the fire, a proofing element having insulating material is provided. A cover made from sheet metal and/or foil material is provided for the proofing element. In each case a bulkhead element, a proofing element and a sheet metal/foil cover are integrated, with the proofing element being included between the bulkhead element and the sheet metal/foil cover, into a proofing/bulkhead element as a structural element. Such a proofing system is suitable particularly for the protection of aircraft components against the action of fire.

WO2007/057202 discloses a folding bulkhead and a device for shutting off a room against a fluid, especially an inflammable liquid, flowing into the room or out of the room. The device has a folding bulkhead which can be pivoted about an axis out of a first position into a second position. A flexible seal is provided, which has at least one tab which projects beyond a margin running transversally with respect to the axis and which is connected to the folding bulkhead and to a frame. At least one shielding means is provided adjacently to the at least one tab.

Proceeding from this, the object on which the present invention is based is to provide a sheet-like, preferably a flexible fire protection unit which has improved fire protection properties.

This object is achieved, according to the invention, by means of a sheet-like, flexible fire protection unit having the features of claim 1. Advantageous developments and refinements are the subject matter of the dependent claims.

The sheet-like, flexible fire protection unit according to the invention is distinguished in that it has at least one porous carrying structure. The pores of the carrying structure are filled at least partially with a medium which, under the action of heat, carries out at least one change in state of aggregation. The pores of the carrying structure may be of different sizes. The carrying structure is preferably formed at least partially from mineral fiber. The pores of the carrying structure may also be in the form of ducts.

The change in state of aggregation may be a melting and/or evaporation process. What is achieved by the change in state of aggregation is that the temperature of the fire protection unit does not rise or rises only insignificantly for a certain time, so that the time span within which the fire protection unit is active can be increased.

The effectiveness of the sheet-like fire protection unit according to the invention may be increased even further in that the medium which carries out a change in state of aggregation has a preferably high heat capacity. It is advantageous if the carrying structure is formed from material which has low heat conductivity. The transport of heat into the medium is thereby reduced. The effectiveness of the fire protection unit is increased as a result.

The medium may be in solid, for example granular, form. There is also the possibility that the medium is a liquid or a pasty liquid. If appropriate, the medium may be present in bound form. This may be achieved preferably in that the medium is used together with absorbers. The absorbers may be organic or inorganic absorbers.

According to an advantageous development of the fire protection according to the invention, it is proposed that the carrying structure be surrounded at least partially by a vapor barrier. This ensures that the medium, which evaporates, for example, under the action of heat, remains in the carrying structure for longer. Furthermore, providing the vapor barrier has the advantage that improved storage of the fire protection unit is thereby achieved.

The vapor barrier may preferably be one which is formed at least partially by a foil.

A refinement is especially preferred in which the vapor barrier closes off the carrying structure essentially hermetically with respect to the surroundings.

To increase the service life of the fire protection unit, it is proposed, according to a further advantageous refinement of the fire protection unit, that at least two carrying structures displaceable in relation to one another be provided.

The carrying structure may also be designed in such a way that it has chambers which are separated from one another by preferably flexible webs. The individual chambers may be filled with identical or different media.

A refinement of the fire protection unit is especially preferred in which the webs are vapor-permeable. A certain pressure equalization within the chambers when the medium evaporates under the action of heat is thereby achieved.

A further refinement of the fire protection unit is especially preferred in which the at least one foil is at least partially selectively permeable, preferably permeable.

When evaporation of the medium occurs during the action of heat upon the fire protection unit, the pressure within the chamber or chambers rises. In order to ensure that the foils are not destroyed when a permissible maximum pressure is overshot, a certain pressure equalization can be achieved in that the at least one foil is at least partially selectively permeable. This refinement has the advantage, further, that the surface of the foil is provided with a vapor film or liquid film, specifically as a function of the medium and the permeability of the foil. This vapor or liquid layer increases the effectiveness of the fire protection unit.

The medium is preferably formed by a liquid or a mixture of at least two liquids. The liquids or the at least one liquid have or has preferably a high viscosity. The liquid may, in particular, be used in conjunction with a flexible fabric, preferably quartz/glass fiber. In this case, the fibers are preferably applied parallel to the protecting part of the foil, so that the interspace can be taken up with the liquid.

According to yet a further advantageous refinement of the fire protection unit according to the invention, it is proposed that the medium is formed at least partially by a charged absorber.

The fire protection unit according to the invention may be used directly or indirectly. Thus, for example, there is the possibility of using the fire protection unit in the form of a fire protection wall. This fire protection wall may be fixed. There is also the possibility of designing the fire protection unit according to the invention as a movable fire protection wall, in particular a traveling rollable fire protection wall. The fire protection unit according to the invention may also be employed to be used where it is temporarily required. Thus, for example, such a fire protection unit may be provided at a suitable location from which the fire protection unit is then transported to the place of use.

The fire protection unit according to the invention may, for example, also be an integral part of fire doors or the like. In particular, the fire protection unit according to the invention is suitable for forming fire protection curtains which, for example, comprise a curtain which is formed from a plurality of strips partially overlapping one another, so that, for example, persons can escape through this curtain.

According to a further inventive idea, a device for shutting off a room against a fluid, especially an inflammable liquid, flowing into the room or out of the room is proposed. The device has at least one flexible fire protection unit. The fire protection unit comprises at least one porous carrying structure, the pores of the carrying structure being filled at least partially with at least one medium which, under the action of heat, carries out at least one change in state of aggregation.

The device according to the invention is distinguished especially in that the fire protection unit is designed as claimed in at least one of claims 2 to 10.

The device comprises a bulkhead which is preferably a folding bulkhead.

According to yet a further advantageous refinement of the device, it is proposed that the fire protection unit be connected to a bulkhead.

Further details and advantages of the invention are explained by means of the exemplary embodiments illustrated in the drawing, without the subject of the invention being restricted to these concrete exemplary embodiments.

Figure 2:
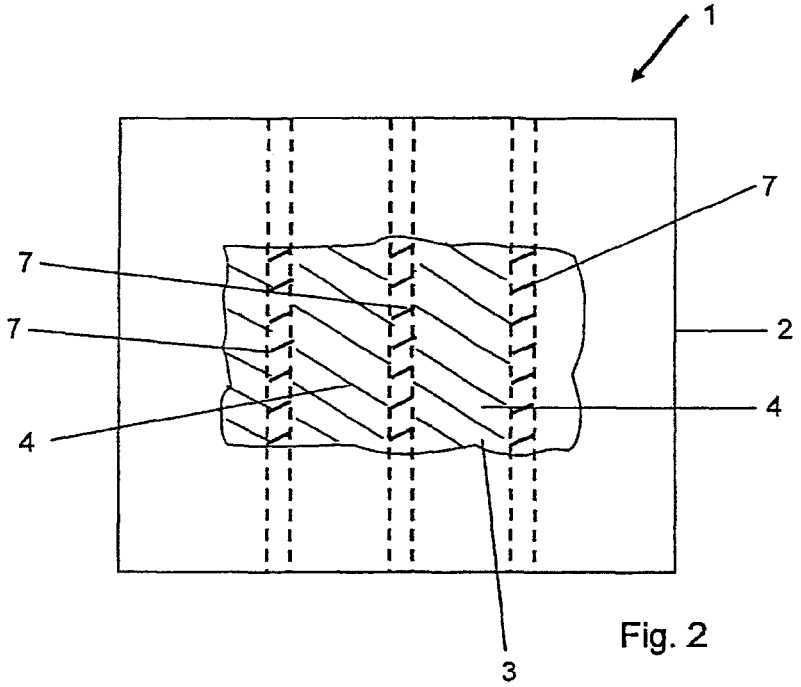
Figure 3:
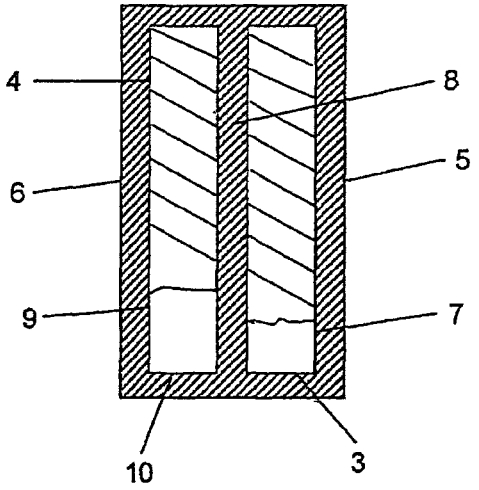
Figure 4:
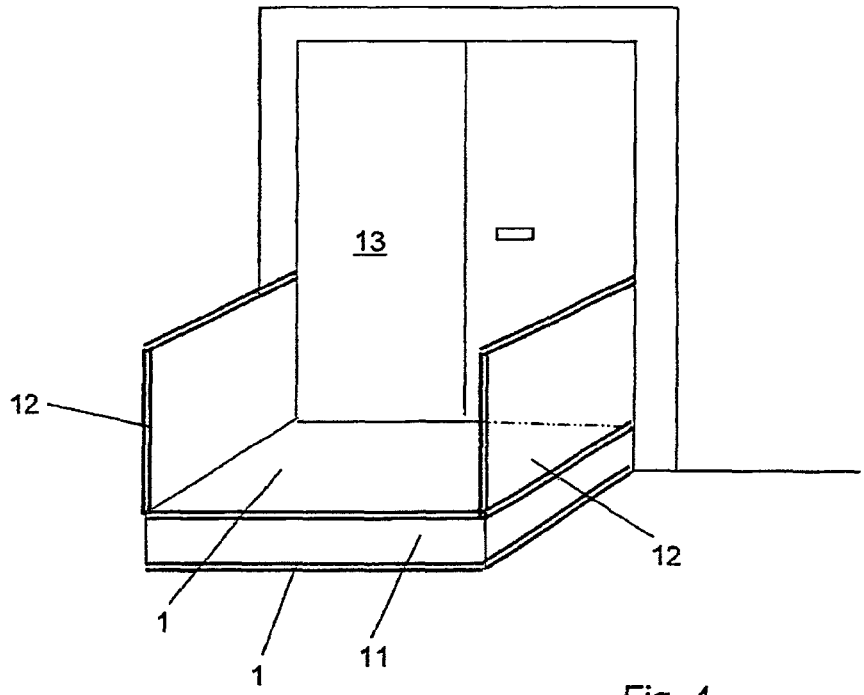
Figure 5:
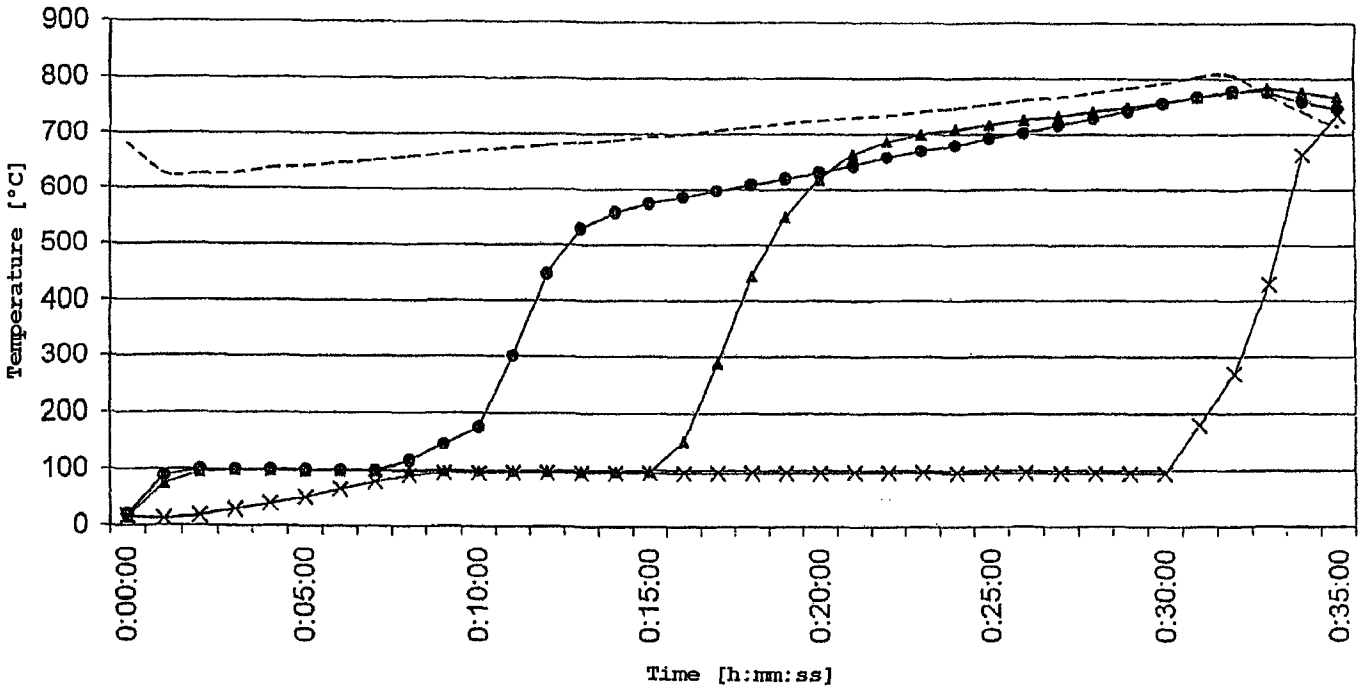

In the drawing:

FIG. 1 shows diagrammatically a first exemplary embodiment of a fire protection unit in section, FIG. 2 shows a second embodiment of a fire protection unit in a front view, FIG. 3 shows the fire protection unit according to FIG. 2 in section, FIG. 4 shows an exemplary embodiment of a device for shutting off a room, and FIG. 5 shows diagrammatically the temperature profile against time.

FIG. 1 shows a first exemplary embodiment of a sheet-like, flexible fire protection unit in section. The fire protection unit 1 has a carrying structure 2. The carrying structure 2 is formed by a fiber mat which is porous. Within the pores 3 is arranged a medium 4 which, under the action of heat, changes such that, for example, it evaporates. The structure 2 is surrounded by foils 5, 6 which form a vapor barrier.

The fire protection unit illustrated diagrammatically in FIG. 1 may be produced, for example, in that first, the porous carrying structure 2 is provided. The medium 4 is introduced into the carrying structure 2. The introduction of the medium may take place, for example, in that the carrying structure 2 is dipped, for example, into a bath containing the medium. The medium may also be introduced into the carrying structure by means of at least one roller or a comparable appliance. For this purpose, the medium is applied to the carrying structure. The excess medium is removed from the surface of the carrying structure. The carrying structure is subsequently introduced, together with the medium, into a foil in which the carrying structure is preferably closed off hermetically. To improve the fire protection properties of the fire protection unit, furthermore, the structure is put under a vacuum during production, so that the foil lies sealingly against the surface of the carrying structure. The vacuum is applied such that the fire protection unit preserves flexibility. The orifice necessary for introducing the vacuum is subsequently closed by welding or adhesive bonding.

FIG. 2 illustrates diagrammatically a sheet-like, flexible fire protection unit 1 in a front view. The fire protection unit 1 has a carrying structure 2 which has a plurality of chambers 3. Arranged in each case in each chamber 3 is a medium 4 which, under the action of heat, carries out at least one change in state of aggregation.

It is clear from the sectional illustration according to FIG. 3 that the carrying structure 2 is formed by foils 5, 6 and 8. The foils 5, 6 and 8 are designed to be spaced apart from one another. The foils 5, 8 are connected to one another by means of webs 7. The foils 6, 8 are connected to one another by means of webs 9. They in each case form chambers 3, 10 which, in the exemplary embodiment illustrated, extend essentially parallel to one another. The webs 7, 9 may be designed to be offset to one another, so that the chambers 3, 10 partially overlap one another.

The medium 4 which is arranged in the chambers 3, 10 is preferably a medium having an absorber which is charged with a liquid. The absorber may be an organic or inorganic absorber.

For storage of the fire protection unit and for dimensional stabilization, the procedure for producing the fire protection unit may be such that the chambers are put under a specific vacuum and subsequently the chambers are closed so as to be air-tight. The height of the vacuum has effects on the rigidity of the fire protection unit 1.

The foils 5, 6 are preferably designed to be semi-permeable, so that the liquid which, if appropriate, is bound in the chambers can escape from the fire protection unit 1 through the foils 5, 6 in the form of vapor after a change in state of aggregation.

FIG. 4 illustrates diagrammatically a device for shutting off a room against a fluid flowing in the room or out of the room. The device has a bulkhead 11 which, in the exemplary embodiment illustrated, can be pivoted about an axis running essentially horizontally. The bulkhead 11 is provided, at least on the top side and underside, with a fire protection unit, such as is illustrated, for example, in FIG. 1. Provided on both sides of the bulkhead are covers 12 which are designed in such a way that they are flexible and have a carrying structure with at least one chamber in which is arranged at least one medium which, under the action of heat, carries out at least one change in state of aggregation.

What is achieved by the configuration according to the invention of the device for shutting off a room against a fluid, especially an inflammable fluid, flowing into the room or out of the room is that the fire protection unit 1 brings about a liquid-tight shut-off of a thoroughfare 13, so that the liquid cannot flow out of the room or into a room. Since the fire protection unit has a medium which, under the action of heat, carries out at least one change in state of aggregation, what is achieved is that the liquid-tight foil is protected. Disintegration of the foil due to heat is essentially avoided.

What is achieved by the configuration according to the invention of the device is that the bulkhead, in particular the folding bulkhead, can have a relatively lightweight design.

FIG. 5 illustrates diagrammatically the temperature profile against time. The time is given in minutes.

FIG. 5 shows the temperature profile inside a furnace by dashes. The dotted profile of the temperature rise during time describes the change of the temperature in a fire protection unit which is of two-ply design. The temperature profile is measured between the two plies of the fire protection unit. The fire protection unit comprises two porous carrying structures which have pores. These are filled with a superabsorber. The carrying structures are enclosed in each case in a vapor barrier. It is clear from the profile of the temperature between these two plies that, after approximately 7 minutes, the temperature rises relatively quickly from 100° C. to approximately 500° C.

It can be seen from the temperature profile identified by triangles that, between two plies of the fire protection unit, the temperature remains at a value of approximately 100° C. for approximately 15 minutes. The two plies correspond essentially to the set-up of the abovementioned furnace test, the thickness of the carrying structure amounting to 6 mm.

In the case of a two-ply fire protection unit having a carrying structure in each case of 12 mm, a steep temperature rise occurs only after approximately 30 minutes. Up to 30 minutes, the temperature between the two plies remains at approximately 100° C.

LIST OF REFERENCE SYMBOLS

1 Fire protection unit
2 Carrying structure
3 Chamber
4 Medium
5 Foil
6 Foil
7 Web
8 Foil
9 Web
10 Chamber
11 Bulkhead
12 Cover
13 Thoroughfare

The invention claimed is:

1. A device for liquid-tight shutting off a room against an inflammable liquid flowing into the room or out of the room, wherein the device comprises:

a folding bulkhead which is pivotable about an axis running horizontally out of a first position into a second position, in which second position liquid-tight shutting off the room against the inflammable liquid flowing into the room or out of the room is achieved; and a flexible fire protection unit connected to the folding bulkhead, the flexible fire protection unit having at least one porous carrying structure defining pores, the pores defined by the at least one porous carrying structure being filled at least partially with at least one medium;

wherein the at least one medium is formed with an absorber which is charged with a liquid;

wherein the at least one porous carrying structure is surrounded by a vapor barrier which closes off the at least one porous carrying structure hermetically with respect to the surroundings;

wherein the at least one medium, under the action of heat, carries out at least one change in state of matter;

wherein the at least one carrying structure has chambers which are separated from one another by webs; and wherein the vapor barrier is formed by a foil.

2. The device as claimed in claim 1, wherein the at least one porous carrying structure is formed at least partially from mineral fibers.

3. The device as claimed in claim 1, wherein the flexible fire protection unit comprises at least two porous carrying structures displaceable in relation to one another.

4. The device as claimed in claim 1, wherein the pores defined by the at least one porous carrying structure are in the form of ducts.

5. The device as claimed in claim 1, wherein the at least one medium which carries out the at least one change in state of matter has a high heat capacity; and wherein the at least one porous carrying structure is formed from material which has low heat conductivity.

6. The device as claimed in claim 1, wherein the folding bulkhead is placed in front of a thoroughfare and wherein the flexible fire protection unit comprises a liquid-tight foil and brings about a liquid-tight shut-off of the thoroughfare even if the inflammable liquid is burning, in that the at least one change in state of matter of the at least one medium protects the liquid-tight foil from disintegration due to the heat of the burning liquid.

7. A device for liquid-tight shutting off a room against an inflammable liquid flowing into the room or out of the room, wherein the device comprises:

a folding bulkhead which is pivotable about an axis running horizontally out of a first position into a second position, in which second position liquid-tight shutting off the room against the inflammable liquid flowing into the room or out of the room is achieved;

a flexible fire protection unit connected to the folding bulkhead, the flexible fire protection unit having at least one porous carrying structure defining pores, the pores defined by the at least one porous carrying structure being filled at least partially with at least one medium, the at least one medium, under the action of heat, carrying out at least one change in state of matter; and covers provided on both sides of the folding bulkhead, the covers being flexible and having at least one porous carrying structure defining pores, the pores defined by the at least one carrying structure being filled at least partially with at least one medium, the at least one medium, under the action of heat, carrying out at least one change in the state of matter;

wherein the at least one medium is formed with an organic or inorganic absorber which is charged with a liquid;

wherein the at least one carrying structure has chambers which are separated from one another by webs; and wherein the vapor barrier is formed by a foil.

8. The device as claimed in claim 7, wherein the at least one porous carrying structure is surrounded at least partially by a vapor barrier.

9. The device as claimed in claim 8, wherein the vapor barrier is formed by a foil.

10. The device as claimed in claim 7, wherein the folding bulkhead is placed in front of a thoroughfare and wherein the flexible fire protection unit comprises a liquid-tight foil and brings about a liquid-tight shut-off of the thoroughfare even if the inflammable liquid is burning, in that the at least one change in state of matter of the at least one medium protects the liquid-tight foil from disintegration due to the heat of the burning liquid.

11. The device as claimed in claim 1, wherein a vacuum is present in the at least one porous carrying structure, so that the vapor barrier lies sealingly against a surface of the at least one porous carrying structure.

* * * * *